US008474139B2

(12) United States Patent
Li

(10) Patent No.: US 8,474,139 B2
(45) Date of Patent: Jul. 2, 2013

(54) METHOD OF MANUFACTURING A LIQUID EJECTING HEAD

(75) Inventor: Xin-shan Li, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 319 days.

(21) Appl. No.: 12/728,907

(22) Filed: Mar. 22, 2010

(65) Prior Publication Data

US 2010/0245492 A1 Sep. 30, 2010

(30) Foreign Application Priority Data

Mar. 26, 2009 (JP) ..... 2009-077864

(51) Int. Cl.
*H04R 17/00* (2006.01)
*B41J 2/16* (2006.01)

(52) U.S. Cl.
USPC ..... 29/890.1; 29/25.35; 347/47; 347/69; 347/72

(58) Field of Classification Search
USPC ..... 29/25.35, 890.1, 851, 830; 347/68–72, 347/47; 257/747
See application file for complete search history.

(56) References Cited

U.S. PATENT DOCUMENTS 5,828,127 A * 10/1998 Yamagata et al. ..... 257/747 X
2008/0012910 A1* 1/2008 Matsuda et al. ..... 347/68

FOREIGN PATENT DOCUMENTS

JP 05286142 A * 11/1993 ..... 29/890.1
JP 2001-105595 4/2001
JP 2002-164586 6/2002
JP 2004-268397 9/2004

* cited by examiner

*Primary Examiner* — A. Dexter Tugbang
(74) *Attorney, Agent, or Firm* — Workman Nydegger

(57) ABSTRACT

Provided is a method of manufacturing a liquid ejecting head, the method including forming a piezoelectric element having a width in a reference direction longer than a width in an orthogonal direction orthogonal to the reference direction on a first substrate, and adhering a second substrate to a surface of the first substrate opposed to the piezoelectric element at a temperature higher than a normal temperature, wherein, in the adhering of the second substrate, the second substrate is adhered such that the first direction of the second substrate is adjusted to the reference direction, using a first thermal expansion coefficient in a first direction on an adhesion surface with the first substrate greater than a second thermal expansion coefficient in a second direction orthogonal to the first direction and the first thermal expansion coefficient greater than a thermal expansion coefficient of the first substrate.

2 Claims, 8 Drawing Sheets

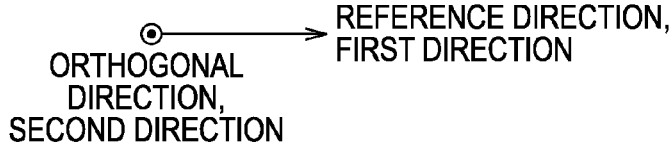
FIG. 4A
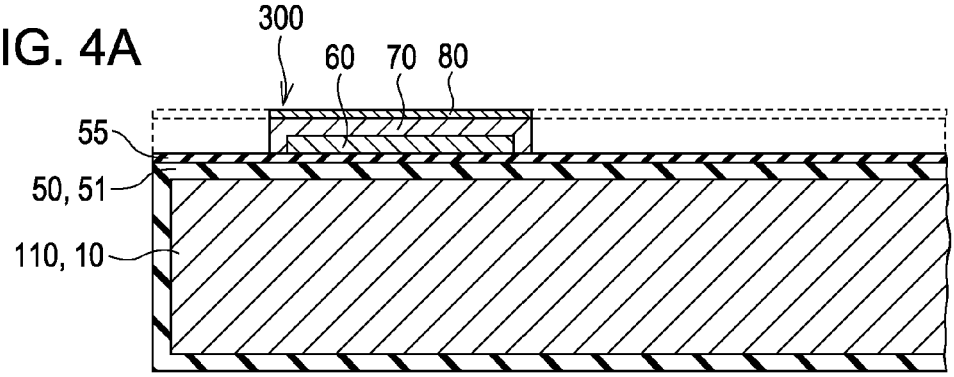
FIG. 4B
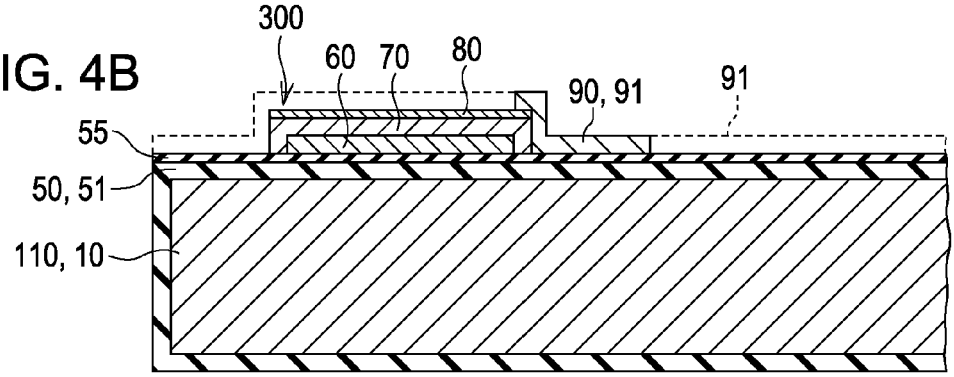
FIG. 4C
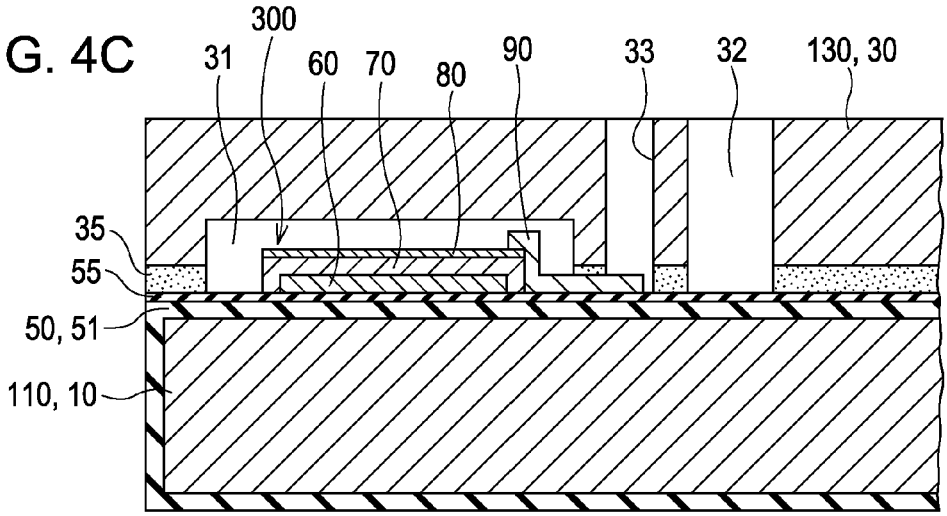

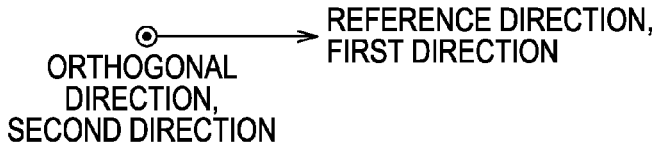
FIG. 6A
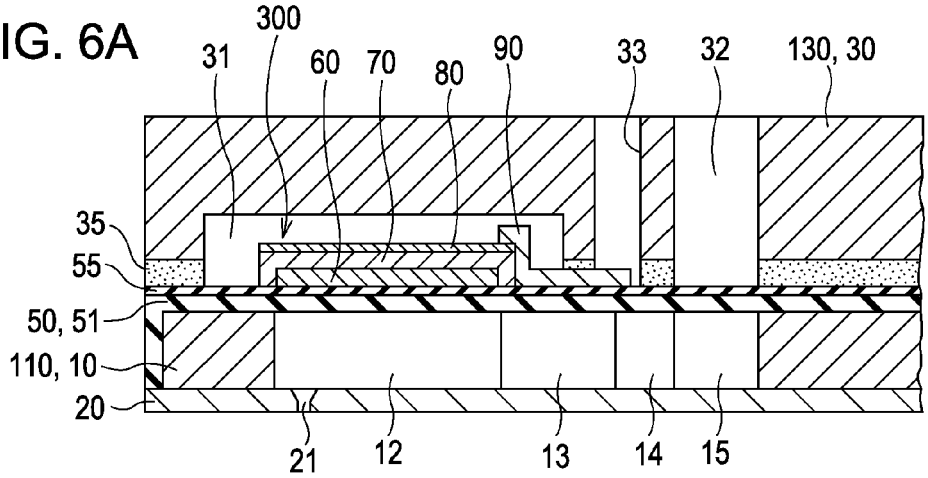
FIG. 6B
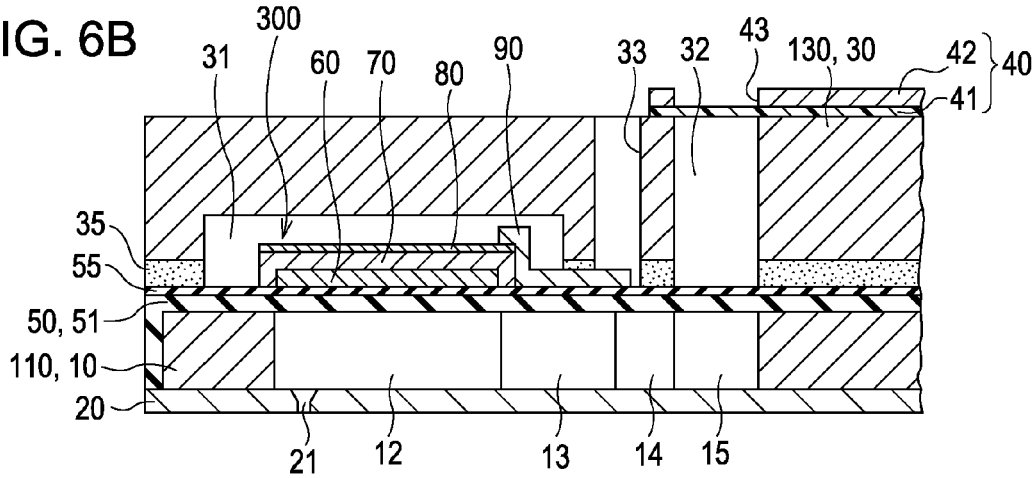

METHOD OF MANUFACTURING A LIQUID EJECTING HEAD

The entire disclosure of Japanese Patent Application No. 2009-077864, filed Mar. 26, 2009 is expressly incorporated by reference herein.

BACKGROUND

1. Technical Field

The present invention relates to a method of manufacturing a liquid ejecting head, a liquid ejecting head, and a liquid ejecting apparatus and, more particularly, to a method of manufacturing an ink jet recording head for ejecting an ink as a liquid, an ink jet recording head, and an ink jet recording apparatus.

2. Related Art

In an ink jet recording head which is a representative example of a liquid ejecting head generally, ink from an ink cartridge in which the ink is reserved is supplied to nozzle openings via an ink supply needle inserted into the ink cartridge and a channel and the ink is ejected from the nozzle openings by driving a piezoelectric element.

As such a piezoelectric element, for example, use of deflection deformation of a piezoelectric element including a lower electrode, a piezoelectric layer and an upper electrode is put to practical use. As a piezoelectric element of a deflection vibration mode, a technique of relaxing tensile stress applied from a substrate such as a vibration plate to a piezoelectric element by adjusting the film thickness of the lower electrode of the piezoelectric element is suggested (for example, JP-A-2002-164586). In addition, the piezoelectric layer of such a piezoelectric element is formed with a predetermined thickness by laminated piezoelectric films, by repeatedly performing a process of heating a piezoelectric precursor film with a heater so as to perform crystallization and form a piezoelectric film plural times.

However, the piezoelectric element of the deflection vibration mode is deformed in a short side direction (widthwise direction) when a voltage is applied, but the deformation thereof in a longitudinal direction is restricted by a vibration plate. Accordingly, when the voltage is applied, the piezoelectric element receives a strong tensile stress in the longitudinal direction from the vibration plate, and cracks occur in the piezoelectric layer along the widthwise direction of the piezoelectric element due to the tensile stress, and thus the piezoelectric element is broken.

Such tensile stress occurs due to the process of heating the piezoelectric layer so as to perform crystallization and then cooling the piezoelectric layer. That is, compression stress occurs in the piezoelectric layer due to the cooling, but the deformation is restricted by the vibration plate as described above. Accordingly, the piezoelectric element receives tensile stress from the vibration plate and thus cracks occur in the piezoelectric element from the tensile stress.

In the piezoelectric element according to JP-A-2002-164586, in particular, the relaxation of the tensile stress received from the vibration plate in the longitudinal direction is not sufficient, and the film thickness of the lower electrode configuring the piezoelectric element is adjusted. Accordingly, a manufacturing process is troublesome.

Such a problem occurs in not only an ink jet recording head unit but also a liquid ejecting head unit for ejecting a liquid other than the ink.

SUMMARY

An advantage of some aspects of the invention is that it provides a method of manufacturing a liquid ejecting head, a liquid ejecting head, and a liquid ejecting apparatus, which is capable of suppressing the occurrence of cracks in a piezoelectric layer due to tensile stress of a piezoelectric element in a longitudinal direction received from a substrate.

According to an aspect of the invention, there is provided a method of manufacturing a liquid ejecting head, the method including: forming a piezoelectric element having a width in a reference direction longer than a width in an orthogonal direction orthogonal to the reference direction on a first substrate; and adhering a second substrate to a surface of the first substrate opposed to the piezoelectric element at a temperature higher than a normal temperature, wherein, in the adhering of the second substrate, the second substrate is adhered such that the first direction of the second substrate is adjusted to the reference direction, using a first thermal expansion coefficient in a first direction on an adhesion surface with the first substrate greater than a second thermal expansion coefficient in a second direction orthogonal to the first direction and the first thermal expansion coefficient greater than a thermal expansion coefficient of the first substrate.

In this aspect, when the first substrate and the second substrate are adhered at a temperature higher than the normal temperature and the temperature is then returned to the normal temperature, the second substrate is more contracted in the first direction because the first thermal expansion coefficient is greater than the second thermal expansion coefficient. In addition, since the first thermal expansion coefficient of the second substrate is greater than the thermal expansion coefficient of the first substrate, the contraction amount of the second substrate is greater than that of the first substrate. Accordingly, stress in a direction in which the second substrate is compressed in the first direction is applied to the first substrate such that the tensile stress in the reference direction of the first substrate, which is applied to piezoelectric element, may be reduced. Therefore, it is possible to suppress breakage of the piezoelectric element by the tensile stress in the reference direction of the first substrate.

The forming of the piezoelectric element may include juxtaposing a plurality of piezoelectric elements on the first substrate in the orthogonal direction and juxtaposing a plurality of pressure generation chambers on the first substrate in the orthogonal direction in correspondence with the piezoelectric elements, and, in the adhering of the second substrate, the second substrate may be a nozzle plate in which a plurality of nozzle openings is formed in the second direction, and an absolute value of a difference between the second thermal expansion coefficient of the nozzle plate and a thermal expansion coefficient of a channel forming substrate may be smaller than the absolute value of the difference between the first thermal expansion coefficient and the thermal expansion coefficient of the channel forming substrate. By setting the absolute value of the difference between the second thermal expansion coefficient of the second substrate and the thermal expansion coefficient of the first substrate to be smaller than the absolute value of the difference between the first thermal expansion coefficient of the second substrate and the thermal expansion coefficient of the first substrate, it is possible to relatively decrease the warpage of the second substrate in the second direction in which the nozzle openings are juxtaposed. Therefore, it is possible to restrict the deviation of the impact positions of the liquid ejected from the nozzle openings in the first direction and to easily correct the impact positions by the adjustment of the ejection timing of the liquid.

According to another aspect of the invention, there is provided a liquid ejecting head manufactured by the above-described method. In this aspect, it is possible to suppress breakage of the piezoelectric element and to provide a liquid ejecting head with improved durability and reliability.

According to another aspect of the invention, there is provided a liquid ejecting head including: a first substrate on which a piezoelectric element having a width in a reference direction longer than a width in an orthogonal direction orthogonal to the reference direction is formed; and a second substrate in which a first thermal expansion coefficient in a first direction on an adhesion surface with the first substrate is greater than a second thermal expansion coefficient in a second direction orthogonal to the first direction and the first thermal expansion coefficient is greater than a thermal expansion coefficient of the first substrate, wherein the second substrate is adhered to a surface of the first substrate opposed to the piezoelectric element such that the first direction is adjusted to the reference direction to have compression stress in the reference direction.

In this aspect, stress in a direction in which the second substrate is compressed in the first direction is applied to the first substrate such that tensile stress in the reference direction of the first substrate, which is applied to the piezoelectric element, is reduced. Accordingly, it is possible to suppress breakage of the piezoelectric element by the tensile stress in the reference direction of the first substrate. Since the tensile stress in the reference direction, which is received from the first substrate when the piezoelectric element displaces a vibration plate, is also reduced by compression stress in the first direction, which is received from the second substrate, it is possible to suppress breakage of the piezoelectric element by the tensile stress and to improve durability and reliability.

According to another aspect of the invention, there is provided a liquid ejecting apparatus including the above-described liquid ejecting head. In this aspect, it is possible to provide a liquid ejecting apparatus with improved durability and reliability.

BRIEF DESCRIPTION OF THE DRAWINGS

The invention will be described with reference to the accompanying drawings, wherein like numbers reference like elements.

FIGS. 4A to 4C are cross-sectional views showing a method of manufacturing a recording head according to an embodiment of the invention.

FIGS. 6A and 6B are cross-sectional views showing a method of manufacturing a recording head according to an embodiment of the invention.

DESCRIPTION OF EXEMPLARY EMBODIMENTS

Hereinafter, the embodiments of the invention will be described in detail.

Figure 1:
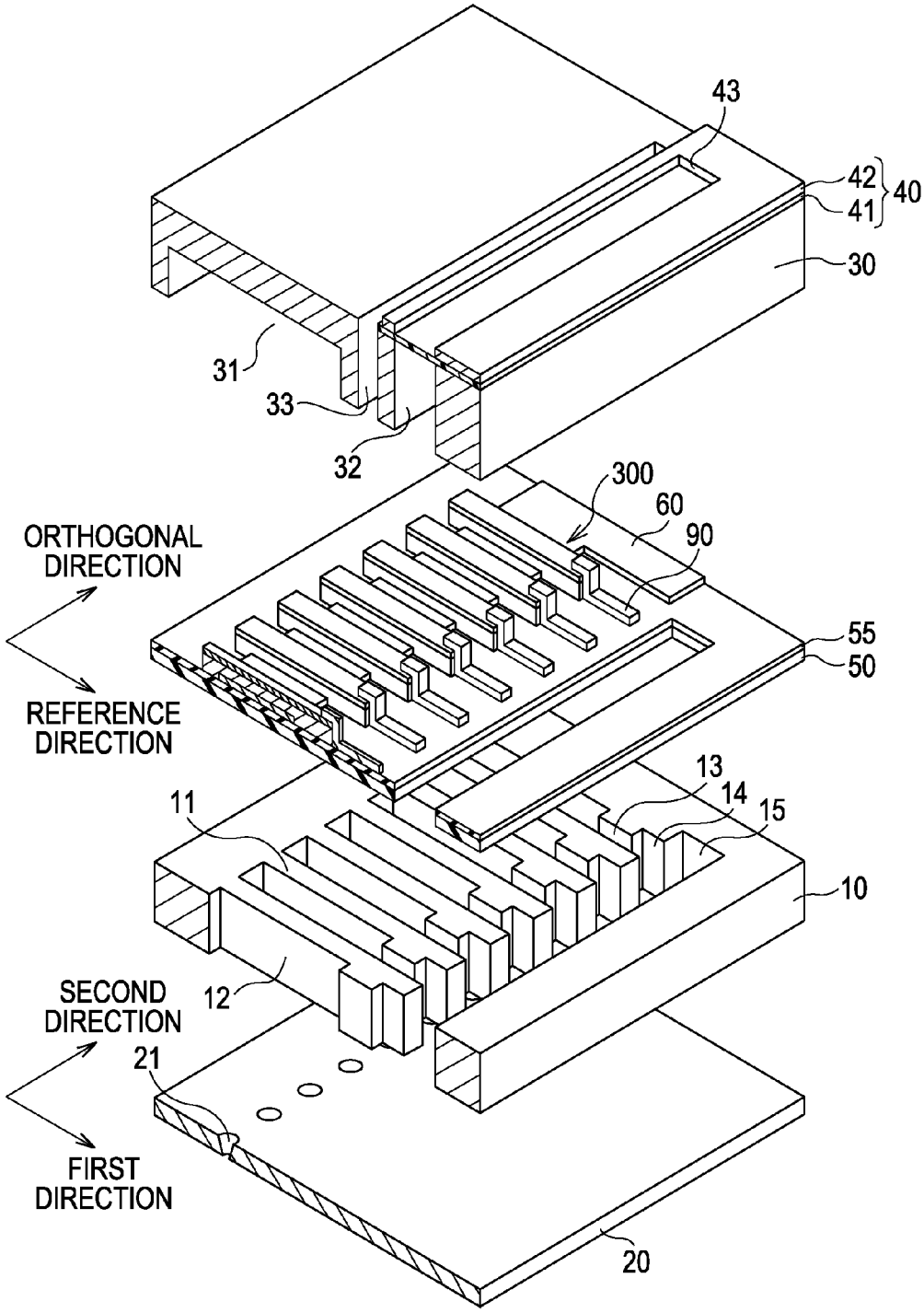
FIG. 1 is an exploded perspective view of a recording head according to an embodiment of the invention.
Figure 2A:
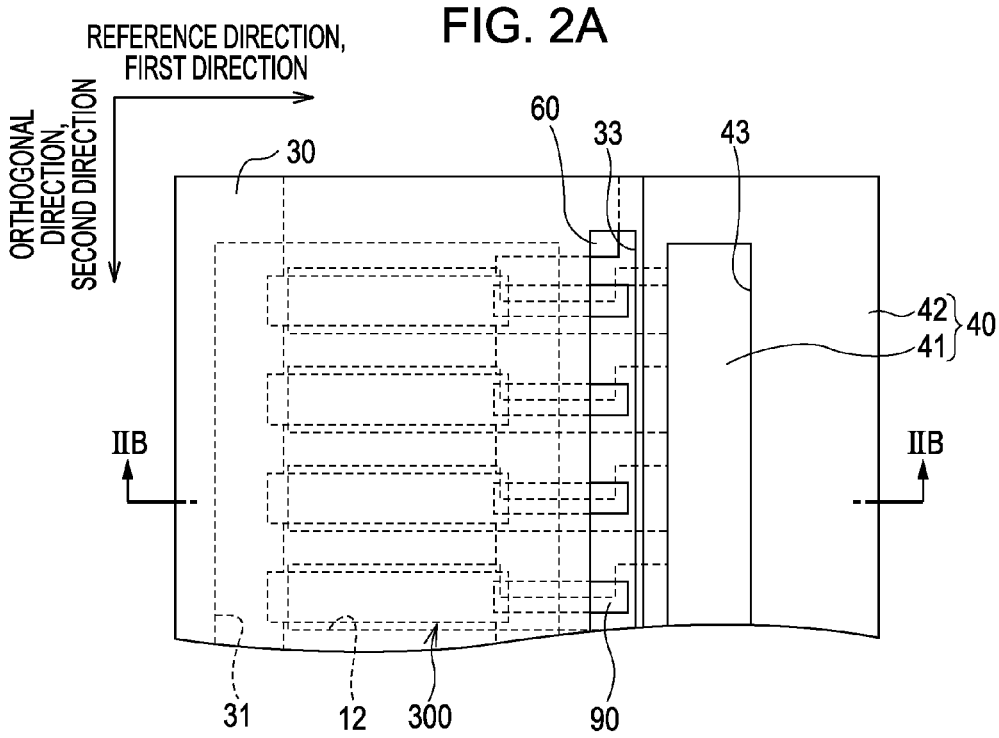
FIGS. 2A and 2B are a plane view and a cross-sectional view of a recording head according to an embodiment of the invention, respectively.
Figure 2B:
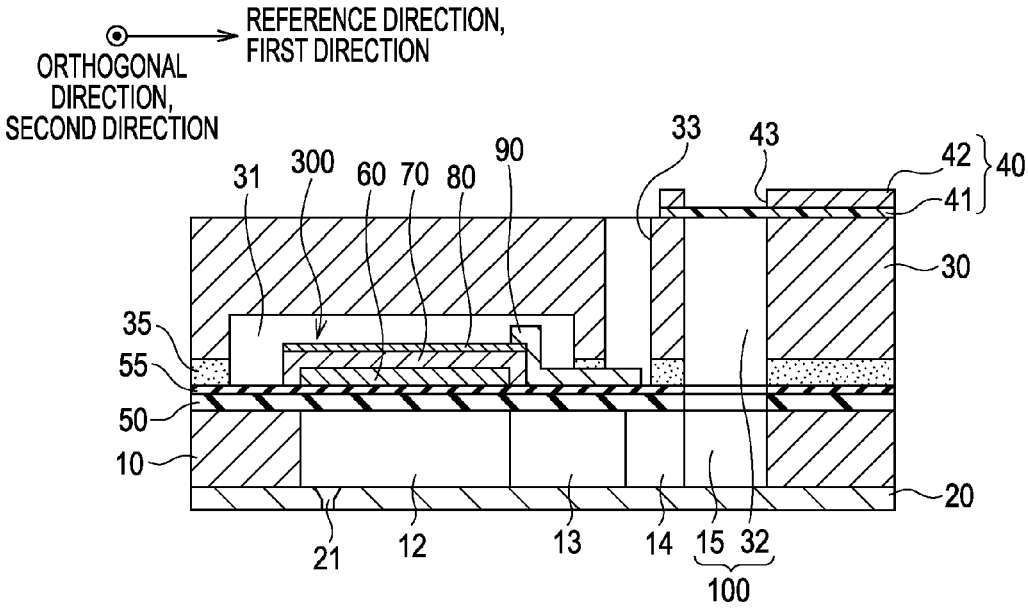

FIG. 1 is an exploded perspective view of an ink jet recording head which is an example of a liquid ejecting head, and FIG. 2 is a plane view of FIG. 1 and a cross-sectional view taken along line IIB-IIB thereof.

As shown, in the present embodiment, a channel forming substrate 10 includes a silicon single crystal substrate having a crystal plane orientation of a surface (110), an elastic film 50 formed of silicon dioxide is formed on one surface thereof by thermal oxidation in advance, and an insulating film 55 is formed on the elastic film 50. In the present embodiment, the channel forming substrate 10, the elastic film 50 and the insulating film 55 configure a first substrate.

In the channel forming substrate 10, pressure generation chambers 12 partitioned by a plurality of partitioning walls 11 are juxtaposed in a widthwise direction (orthogonal direction) thereof, by performing anisotropic etching from the other surface side thereof. At one end side in a longitudinal direction (reference direction) of the pressure generation chambers 12 of the channel forming substrate 10, ink supply paths 13 and communication paths 14 are partitioned by the partitioning walls 11. A communication portion 15 configuring a portion of a reservoir 100 formed of a common ink chamber (liquid chamber) of the pressure generation chambers 12 is formed at one end of each of the communication paths 14. That is, a liquid channel including the pressure generation chambers 12, the ink supply paths 13, the communication paths 14 and the communication portion 15 is provided in the channel forming substrate 10.

The ink supply paths 13 communicate with the one end side in the longitudinal direction of the pressure generation chambers 12 and have a section area smaller than the pressure generation chambers 12. For example, in the present embodiment, the ink supply paths 13 are formed with a width smaller than that of the pressure generation chambers 12, by narrowing the channels of the pressure generation chambers 12 side between the reservoir 100 and the pressure generation chambers 12 in the widthwise direction and channel resistance of the ink flowing from the communication paths 14 to the pressure generation chamber 12 is constantly maintained.

Although the ink supply paths 13 are formed by narrowing the width of the channels from one side thereof in the present embodiment, the ink supply paths may be formed by narrowing the width of the channels from both sides thereof. Alternatively, the ink supply paths may be formed by narrowing in a thickness direction, instead of the narrowing of the width of the channels. In addition, the communication paths 14 communicate with the sides of the ink supply paths 13 opposed to the pressure generation chambers 12 and have a section area larger than that of the ink supply paths 13 in the widthwise direction (orthogonal direction). In the present embodiment, the communication paths 14 are formed with the same section area as the pressure generation chambers 12.

That is, in the channel forming substrate 10, the pressure generation chambers 12, the ink supply paths 13 having the section area smaller than the section area in the widthwise direction of the pressure generation chambers 12, and the communication paths 14 communicating the ink supply paths 13 and having the section area larger than the section area in the widthwise direction of the ink supply paths 13 are partitioned by the plurality of partitioning walls 11.

Meanwhile, the side of the channel forming substrate 10 opposed to an opened surface thereof, as described above, the elastic film 50 formed of silicon dioxide is formed and the insulating film 55 formed of zirconium oxide ($ZrO_2$) is laminated and formed on the elastic film 50.

On the insulating film 55, a plurality of piezoelectric elements 300 having a width in a reference direction larger than a width in an orthogonal direction orthogonal to the reference direction is juxtaposed.

Each of the piezoelectric elements 300 is formed by laminating a lower electrode film 60 formed of, for example, platinum (Pt) or iridium (Ir), a piezoelectric layer 70 formed of lead zirconate titanate (PZT) which is an example of a piezoelectric material, and an upper electrode film 80 formed of, for example, platinum (Pt) or iridium (Ir). Here, the piezoelectric element 300 indicates the portion including the lower electrode film 60, the piezoelectric layer 70 and the upper electrode film 80.

In general, any one electrode of the piezoelectric element 300 is a common electrode and the other electrode and the piezoelectric layer 70 are patterned for each of the pressure generation chambers 12.

In the present embodiment, as shown in FIGS. 1 and 2, the lower electrode film 60 is continuously provided over a region facing the plurality of pressure generation chambers 12 so as to become the common electrode of the plurality of piezoelectric elements 300, and the upper electrode film 80 and the piezoelectric layer 70 are separated for each of the piezoelectric elements 300 such that the upper electrode film 80 becomes an individual electrode of each of the piezoelectric elements 300.

The piezoelectric elements 300 and a vibration plate which is displaced by the driving of the piezoelectric elements 300 are collectively called an actuator. Although the elastic film 50, the insulating film 55 and the lower electrode film 60 function as the vibration plate in the above-described example, only the lower electrode film 60 may remain and the lower electrode film 60 may function as the vibration plate, without providing the elastic film 50 and the insulating film 55.

A nozzle plate 20 which is an example of a second substrate is adhered to the opened surface side of the channel forming substrate 10 by an adhesive, a hot welded film or the like. A plurality of nozzle openings 21 is arranged in the nozzle plate 20 in a second direction of an adhesion surface thereof with the channel forming substrate 10 (a direction orthogonal to a first direction of the adhesion surface), and the nozzle openings 21 communicate with the vicinities of the ends opposed to the ink supply paths 13 of the pressure generation chambers 12.

The nozzle plate 20 has anisotropic thermal expansion in the adhesion surface thereof with the channel forming substrate 10. That is, a first thermal expansion coefficient in the first direction of the adhesion surface is greater than a second thermal expansion coefficient in the second direction. In addition, the first thermal expansion coefficient is greater than the thermal expansion coefficient of the channel forming substrate 10. In addition, an absolute value of a difference between the second thermal expansion coefficient and the thermal expansion coefficient of the channel forming substrate 10 is less than an absolute value of a difference between the first thermal expansion coefficient and the thermal expansion coefficient of the channel forming substrate 10.

The nozzle plate 20 is adhered to the channel forming substrate 10 such that the first direction is adjusted to the reference direction of the piezoelectric elements 300, in a state in which compression stress is applied to the first direction. To this end, the tensile stress in the reference direction of the channel forming substrate 10, the elastic film 50 and the insulating film 55 (first substrate) acting on the piezoelectric elements 300 is reduced by the compression tension in the first direction of the nozzle plate 20. Accordingly, it is possible to suppress breakage of the piezoelectric elements 300 by cracks occurring in the piezoelectric layer 70 from the tensile stress in the reference direction of the channel forming substrate 10, the elastic film 50 and the insulating film 55.

In addition, as a material forming such a nozzle plate 20, for example, cold rolled metal (including an alloy) having anisotropic thermal expansion coefficient may be used. In addition, crystal, calcite (calcium carbonate) or CdS (cadmium sulfide) crystal having an anisotropic thermal expansion coefficient may be used.

A lead electrode 90 which is led out from the vicinity of the end of the ink supply path side, is extended onto the insulating film 55, and is formed of, for example, gold (Au) or the like is connected to the upper electrode film 80 which is the individual electrode of each of the piezoelectric elements 300.

On the channel forming substrate 10 on which the piezoelectric elements 300 are formed, that is, on the lower electrode film 60, the elastic film 50 and the lead electrode 90, a protective substrate 30 having a reservoir portion 32 configuring at least a portion of the reservoir 100 is adhered by an adhesive 35. In the present embodiment, the reservoir portion 32 is formed over the widthwise direction of the pressure generation chambers 12 by penetrating the protective substrate 30 in the thickness direction, and communicates with the communication portion 15 of the channel forming substrate 10 so as to configure the reservoir 100 which is the common ink chamber of the pressure generation chambers 12 as described above. The communication portion 15 of the channel forming substrate 10 may be divided into a plurality of portions for the pressure generation chambers 12 such that only the reservoir portion 32 functions as a reservoir. For example, only the pressure generation chambers 12 may be provided in the channel forming substrate 10 and the ink supply paths 13 communicating between the reservoir 100 and the pressure generation chambers 12 may be provided in a member (for example, the elastic film 50, the insulating film 55 and the like) interposed between the channel forming substrate 10 and the protective substrate 30.

A piezoelectric element holding portion 31 for securing a space such that the motion of the piezoelectric elements 300 is not hindered is provided in a region of the protective substrate 30 facing the piezoelectric elements 300. The space of the piezoelectric element holding portion 31 may be sealed or may not be sealed if the space is secured such that the motion of the piezoelectric elements 300 is not hindered.

As such a protective substrate 30, a material having the substantially same thermal expansion coefficient as the channel forming substrate 10, for example, glass, a ceramic material or the like may be preferably used. In the present embodiment, a silicon single crystal substrate which is formed of the same material as the channel forming substrate 10 is used.

A through-hole 33 penetrating the protective substrate 30 in the thickness direction is provided in the protective substrate 30. In addition, the vicinity of the lead electrode 90 led out from each of the piezoelectric elements 300 is provided so as to be exposed in the through-hole 33.

A driving circuit 200 for driving the juxtaposed piezoelectric elements 300 is fixed on the protective substrate 30. As the driving circuit 200, for example, a circuit board or a semiconductor integrated circuit (IC) or the like may be used. In addition, the driving circuit 200 and the lead electrode 90 are electrically connected via a connection wire 121 formed of a conductive wire such as a bonding wire.

A compliance substrate 40 including a sealing film 41 and a fixed plate 42 is adhered to the protective substrate 30. The sealing film 41 is formed of a flexible material with low rigidity (for example, a polyphenylene sulfide (PPS) film having a thickness of 6 μm), and one surface of the reservoir portion 32 is sealed by the sealing film 41. In addition, the fixed plate 42 is formed of a hard material (for example, stainless steel (SUS) or the like with a thickness of 30 μm) such as metal. Since a region of the fixed plate 42 facing the reservoir 100 is an opening 43 which is completely removed in the thickness direction, one surface of the reservoir 100 is sealed only by the flexible sealing film 41.

In the ink jet recording head of the present embodiment, after an ink is introduced from an ink introduction port connected to an external ink supply unit (not shown) and the ink is filled from the reservoir 100 to the nozzle openings 21, a voltage is applied between the lower electrode film 60 and the upper electrode film 80 corresponding to the pressure generation chambers 12 according to a recording signal from the driving circuit 200 such that the elastic film 50, the insulating film 55, the lower electrode film 60 and the piezoelectric layer 70 are deflected and deformed. Thus, the pressure of each of the pressure generation chambers 12 is increased so as to eject ink droplets from the nozzle openings 21.

Hereinafter, a method of manufacturing a liquid ejecting head (ink jet recording head) according to the embodiment of the invention will be described with reference to FIGS. 3A to 6B. FIGS. 3A to 6B are cross-sectional view in a longitudinal direction of each of the pressure generation chambers of the ink jet recording head. In addition, as described below, a plurality of channel forming substrates 10 and protective substrates 30 are integrally formed in a silicon wafer so as to be finally divided into substrates.

Figure 3A:
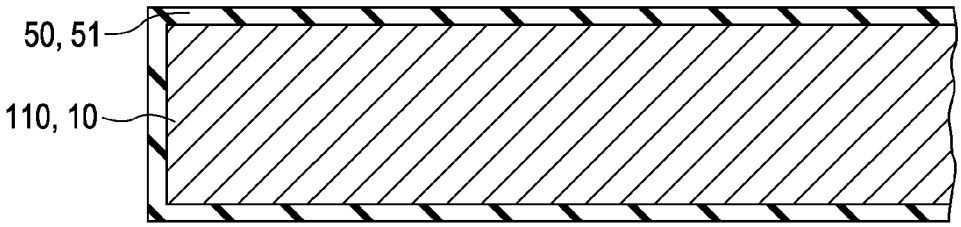
FIGS. 3A to 3C are cross-sectional views showing a method of manufacturing a recording head according to an embodiment of the invention.
Figure 3B:
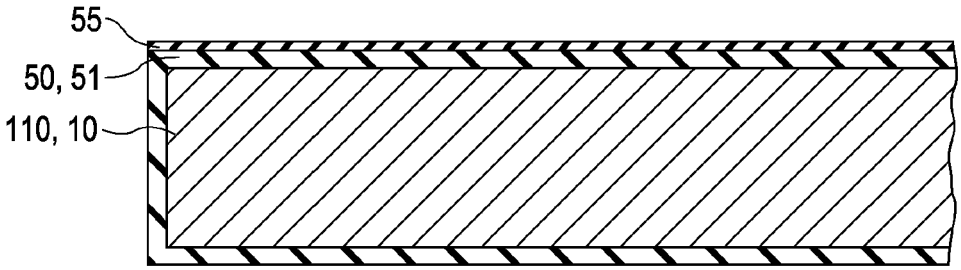

First, as shown in FIG. 3A, an oxide film 51 forming the elastic film 50 is formed on the surface of a wafer 110 for the channel forming substrate which is a silicon wafer. For example, the oxide film 51 formed of silicon dioxide is formed by thermally oxidizing the surface of the wafer 110 for the channel forming substrate. Next, as shown in FIG. 3B, the insulating film 55 formed of an oxide film formed of a material different from that of the elastic film 50 is formed on the elastic film 50 (oxide film 51). In detail, the insulating film 55 formed of zirconium oxide ($ZrO_2$) is formed by forming a zirconium (Zr) layer on the elastic film 50 (oxide film 51) by, for example, a sputtering method and then thermally oxidizing the zirconium layer. Thus, the first substrate including the wafer 110 for the channel forming substrate, the elastic film 50 and the insulating film 55 is formed. Hereinafter, the wafer 110 for the channel forming substrate, the elastic film 50 and the insulating film 55 is referred to as the wafer 110 for the channel forming substrate or the like.

Figure 3C:
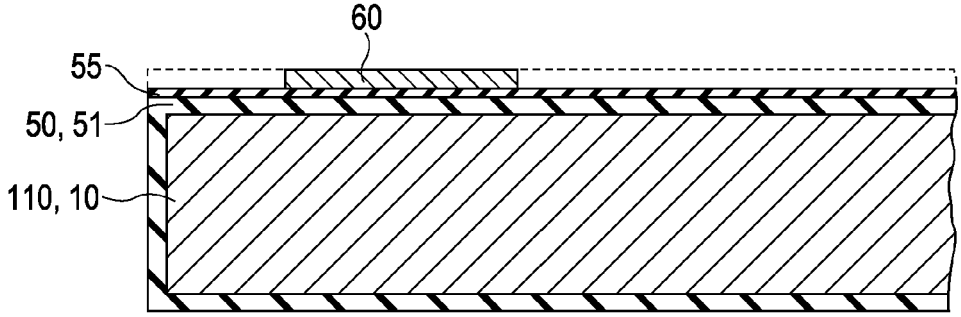

Next, as shown in FIG. 3C, for example, the lower electrode film 60 is formed by laminating platinum and iridium on the insulating film 55 and the lower electrode film 60 is then patterned in a predetermined shape. Next, as shown in FIG. 4A, for example, the piezoelectric layer 70 formed of, for example, lead zirconate titanate (PZT) and the upper electrode film 80 formed of, for example, iridium (Ir) are formed and the piezoelectric layer 70 and the upper electrode film 80 are patterned, thereby forming the piezoelectric elements 300. At this time, the piezoelectric layer 70 and the upper electrode film 80 are patterned such that the plurality of piezoelectric elements 300 are arranged on the wafer 110 for the channel forming substrate in the orthogonal direction.

As the material of the piezoelectric layer 70, for example, a ferroelectric piezoelectric material such as lead zirconate titanate (PZT) or a relaxor ferroelectric obtained by adding metal such as niobium, nickel, magnesium, bismuth, or yttrium thereto may be used. In addition, in the method of forming the piezoelectric layer 70, in the present embodiment, the piezoelectric layer 70 is formed using a so-called sol-gel method of applying, drying and gelling a so-called sol in which a metallic organic substance is dissolved and dispersed in a solvent and performing firing at a high temperature so as to obtain the piezoelectric layer 70 formed of metal oxide. In addition, the method of forming the piezoelectric layer 70 is not specially limited and, for example, a MOD method, a sputtering method or the like may be used.

If the formed piezoelectric elements 300 are cooled, the piezoelectric elements 300 are contracted, but the deformation thereof is restricted by the wafer 110 for the channel forming substrate. Therefore, the piezoelectric elements 300 receive tensile stress from the wafer 110 for the channel forming substrate or the like.

Next, as shown in FIG. 4B, the lead electrode 90 is formed. In detail, a metal layer 91 formed of, for example, gold (Au) or the like is formed over the entire surface of the wafer 110 for the channel forming substrate and the metal layer 91 is patterned for each of the piezoelectric elements 300, thereby forming the lead electrode 90.

Next, as shown in FIG. 4C, a wafer 130 for a protective substrate which is a silicon wafer is adhered to the side of the piezoelectric elements 300 of the wafer 110 for the channel forming substrate by an adhesive 35. In addition, the piezoelectric element holding portion 31, the reservoir portion 32 and the through-hole 33 are formed in the wafer 130 for the protective substrate in advance.

Figure 5A:
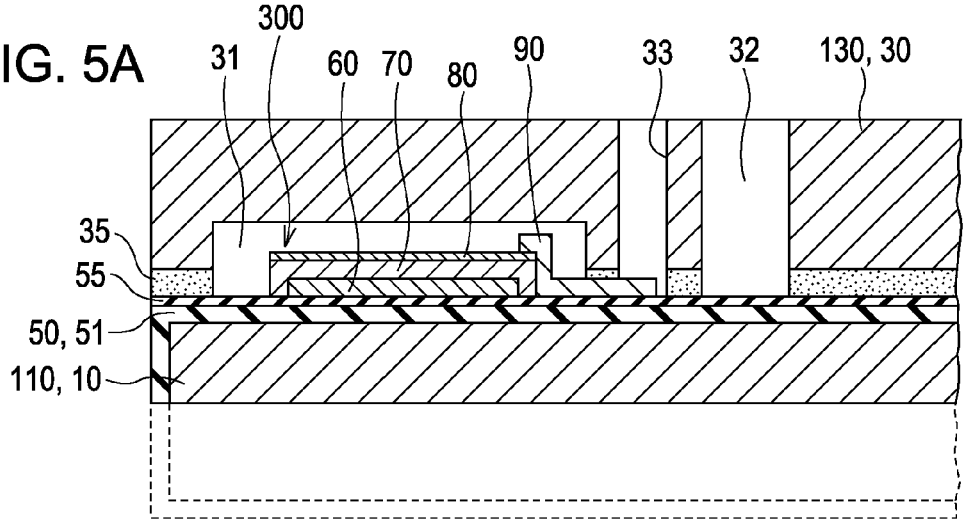
FIGS. 5A to 5C are cross-sectional views showing a method of manufacturing a recording head according to an embodiment of the invention.
Figure 5B:
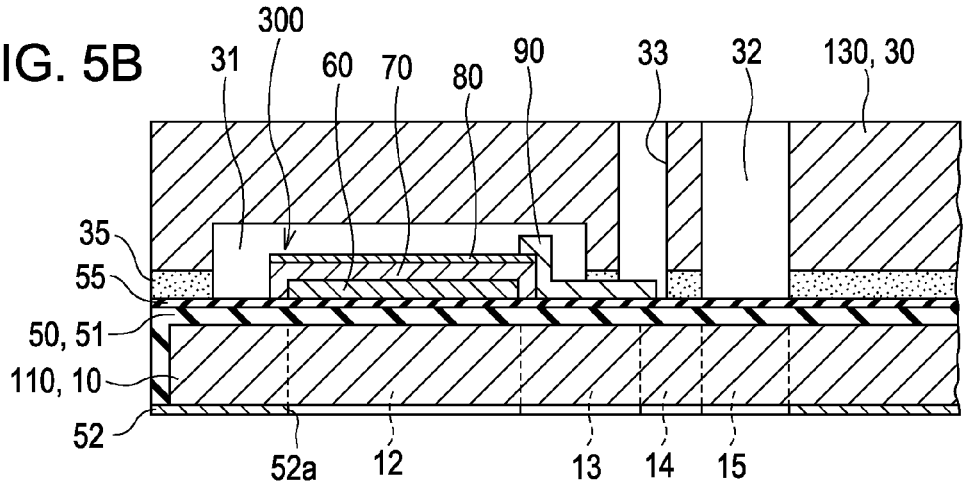
Figure 5C:
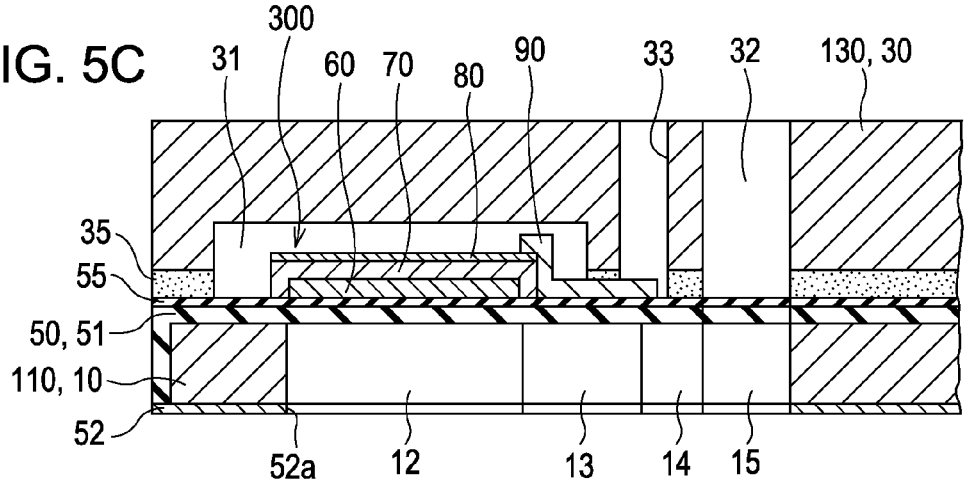

Next, as shown in FIG. 5A, the side of the wafer 110 for the channel forming substrate opposed to the wafer 130 for the protective substrate is processed such that the wafer 110 for the channel forming substrate has a predetermined thickness. Next, as shown in FIG. 5B, a protective film 52 having a predetermined pattern, which functions as a mask when ink channels of the pressure generation chambers 12 or the like are formed, is formed on the surface of the wafer 110 for the channel forming substrate. That is, the protective film 52 having openings 52*a* is formed in regions facing ink channels of the pressure generation chambers 12. Next, as shown in FIG. 5C, the wafer 110 for the channel forming substrate is subjected to anisotropic etching (wet etching) using the protective film 52 as the mask. Thus, the pressure generation chambers 12, the ink supply paths 13, the communication paths 14 and the communication portion 15 configuring the ink channels are formed in the wafer 110 for the channel forming substrate.

Next, although not specially shown, unnecessary portions of outer edges of the wafer 110 for the channel forming substrate and the wafer 130 for the protective substrate are removed by, for example, cutting such as dicing.

Next, as shown in FIG. 6A, at a temperature higher than a normal temperature, the nozzle plate 20 is adhered to the surface of the wafer 110 for the channel forming substrate opposed to the wafer 130 for the protective substrate such that the first direction of the nozzle plate 20 is adjusted to the reference direction of the piezoelectric elements 300. In the present embodiment, the wafer 110 for the channel forming substrate and the nozzle plate 20 are adhered by epoxy resin. The term "normal temperature" described herein refers to a predetermined temperature of a temperature range of an environment in which the ink jet recording head is used, and the normal temperature is a room temperature in the present embodiment.

As described above, in the nozzle plate 20, since the first thermal expansion coefficient is greater than the second thermal expansion coefficient and the first thermal expansion coefficient is greater than the thermal expansion coefficient of the wafer 110 for the channel forming substrate, when the wafer 110 for the channel forming substrate and the nozzle plate 20 are adhered at the temperature higher than the normal temperature, the nozzle plate 20 is adhered to the wafer 110 for the channel forming substrate in a state of being more expanded than the wafer 110 for the channel forming substrate in the first direction.

As shown in FIG. 6B, the temperature is returned to the normal temperature in a state in which the nozzle plate 20 and the wafer 110 for the channel forming substrate are adhered, the compliance substrate 40 is adhered to the wafer 130 for the protective substrate, and the wafer 110 for the channel forming substrate is divided into channel forming substrates 10 each having a size of one chip shown in FIG. 1, thereby manufacturing the ink jet recording head.

Here, when cooling is performed to the normal temperature in a state in which the nozzle plate 20 and the wafer 110 for the channel forming substrate are adhered, they are contracted. Since the first thermal expansion coefficient is greater than the second thermal expansion coefficient, the nozzle plate 20 is more contracted in the first direction. In addition, since the first thermal expansion coefficient of the nozzle plate 20 is greater than the thermal expansion coefficient of the wafer 110 for the channel forming substrate, the contraction amount of the nozzle plate 20 is greater than that of the wafer 110 for the channel forming substrate. Accordingly, stress in a direction in which the nozzle plate 20 is compressed in the first direction is applied to the wafer 110 for the channel forming substrate such that the tensile stress in the reference direction of the wafer 110 for the channel forming wafer, which is applied to piezoelectric elements 300, may be reduced. Therefore, cracks occur in the piezoelectric layer 70 from the tensile stress in the reference direction of the wafer 110 for the channel forming substrate so as to suppress breakage of the piezoelectric elements 300. In addition, since the tensile stress in the reference direction, which is received from the wafer 110 for the channel forming substrate when the piezoelectric elements 300 displace the vibration plate, is also reduced by compression stress in the first direction, which is received from the nozzle plate 20, it is possible to suppress cracks occurring in the piezoelectric elements 300 from the tensile stress and to improve durability and reliability.

Figure 7A:
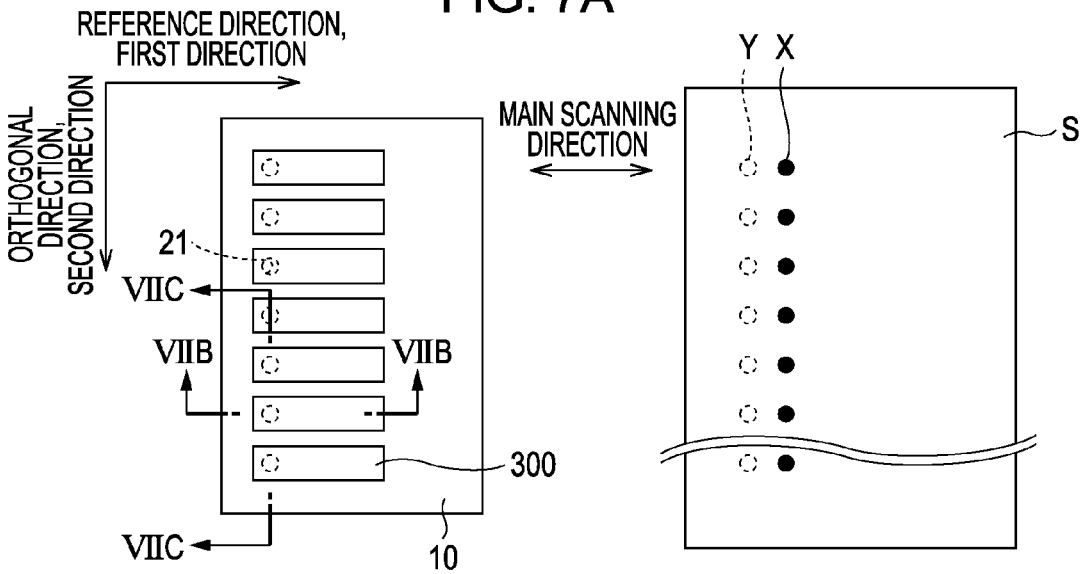
FIGS. 7A to 7D are conceptual diagrams showing a relationship between a recording head according to an embodiment of the invention and liquid droplets.

In the formed ink jet recording head, it is possible to suppress deterioration of impact accuracy of the ink. This will be described using FIGS. 7A to 7D. FIG. 7A is a plan view showing a relationship between the ink jet recording head and a recording sheet (ejected medium), FIG. 7B is a cross-sectional view taken along line VIIB-VIIB of FIG. 7A, FIG. 7C is a cross-sectional view taken along line VIIC-VIIC of FIG. 7A, and FIG. 7D is a cross-sectional view of an ink jet recording head as an comparative example.

As shown in FIG. 7A, the ink jet recording head ejects on the recording sheet S the ink while moving in a direction (main scanning direction) crossing the arrangement direction of the nozzle openings 21.

Meanwhile, the absolute value of a difference between the second thermal expansion coefficient of the nozzle plate 20 and the thermal expansion coefficient of the channel forming substrate 10, the elastic film 50 and the insulating film 55 (all of which will hereinafter be referred to as the channel forming substrate 10) is smaller than the absolute value of a difference between the first thermal expansion coefficient of the nozzle plate 20 and the thermal expansion coefficient of the channel forming substrate 10.

Figure 7B:
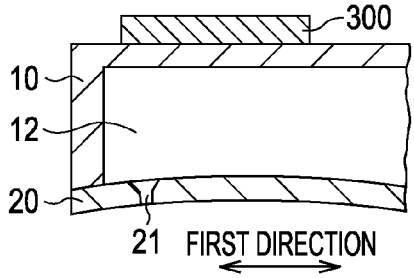
Figure 7C:
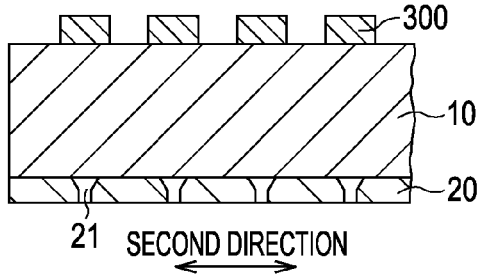
Figure 7D:
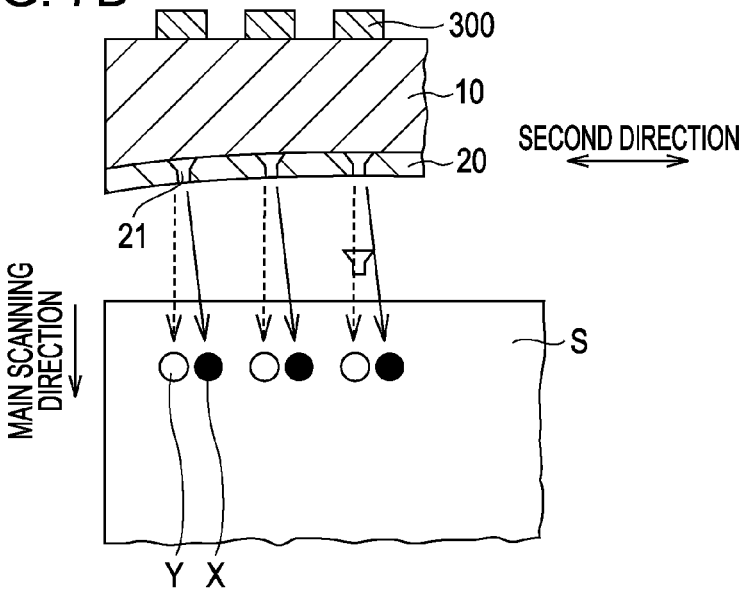

Accordingly, as shown in FIGS. 7B and 7C, if warpage occurs in the nozzle plate 20 and the channel forming substrate 10 due to the difference between the thermal expansion coefficients, the nozzle plate 20 is warped in the first direction and warpage in the second direction is less than warpage in the first direction or becomes substantially flat such that the nozzle plate 20 is substantially warped in only the first direction.

To this end, as shown in FIG. 7A, since the warpage of the nozzle plate 20 is restricted in the first direction, the impact positions X of the ink droplets ejected from the nozzle openings 21 are deviated from original impact positions Y to the main scanning direction. However, the deviation of the impact positions of the ink to the main scanning direction may be corrected by adjusting the ejection timing of the ink droplets of the ink jet recording head.

If the warpage of the nozzle plate 20 in the second direction is large as shown in FIG. 7D, the warpage of the nozzle opening 21 in the arrangement is large, and the impact positions X of the ink droplets ejected from the nozzle openings 21 are deviated from the original impact positions Y in a direction orthogonal to the main scanning direction. It is difficult to correct the deviation of the impact positions by adjusting the ejection timing of the ink droplets of the ink jet recording head.

By setting the absolute value of the difference between the second thermal expansion coefficient of the nozzle plate 20 and the thermal expansion coefficient of the channel forming substrate 10 to be smaller than the absolute value of the difference between the first thermal expansion coefficient of the nozzle plate 20 and the thermal expansion coefficient of the channel forming substrate 10, it is possible to relatively decrease the warpage of the nozzle plate 20 in the second direction in which the nozzle openings 21 are juxtaposed. Therefore, it is possible to restrict the deviation of the impact positions of the ink ejected from the nozzle openings 21 in the first direction and to easily correct the impact positions by the adjustment of the ejection timing of the ink.

Other Embodiment

Although the embodiment of the invention is described above, the invention is not limited to the embodiment.

Although the channel forming substrate 10 is exemplified as the first substrate and the nozzle plate 20 is exemplified as the second substrate in Embodiment 1, the invention is not limited thereto. For example, if a lamination formed of two or more substrates is used as the channel forming substrate, the substrate of the piezoelectric elements 300 side becomes the first substrate and the other substrate becomes the second substrate. Even in this case, since the tensile stress of the first substrate applied to the piezoelectric elements 300 is reduced by the compression stress received from the second substrate, it is possible to prevent the piezoelectric elements 300 from being broken by the tensile stress of the first substrate.

Although the first substrate includes the channel forming substrate 10, the elastic film 50 and the insulating film 55 in Embodiment 1, the invention is not limited thereto. For example, if the elastic film 50 and the insulating film 55 are not provided to the channel forming substrate 10 and the lower electrode film 60 is used as the vibration plate, the lower electrode film 60 as the vibration plate and the channel forming substrate 10 become the first substrate. Even in this case, since the tensile stress from the first substrate is applied to the piezoelectric layer 70 is reduced by the compression stress received from the nozzle plate 20, it is possible to suppress cracks occurring in the piezoelectric layer 70 and to prevent the piezoelectric elements 300 from being broken.

Although the piezoelectric elements having the width in the reference direction longer than the width in the orthogonal direction have a substantially rectangular shape in plan view in Embodiment 1, the invention is not limited thereto. For example, elliptic piezoelectric elements having a long axis in the reference direction and a short axis in the orthogonal direction in plan view may be used.

Figure 8:
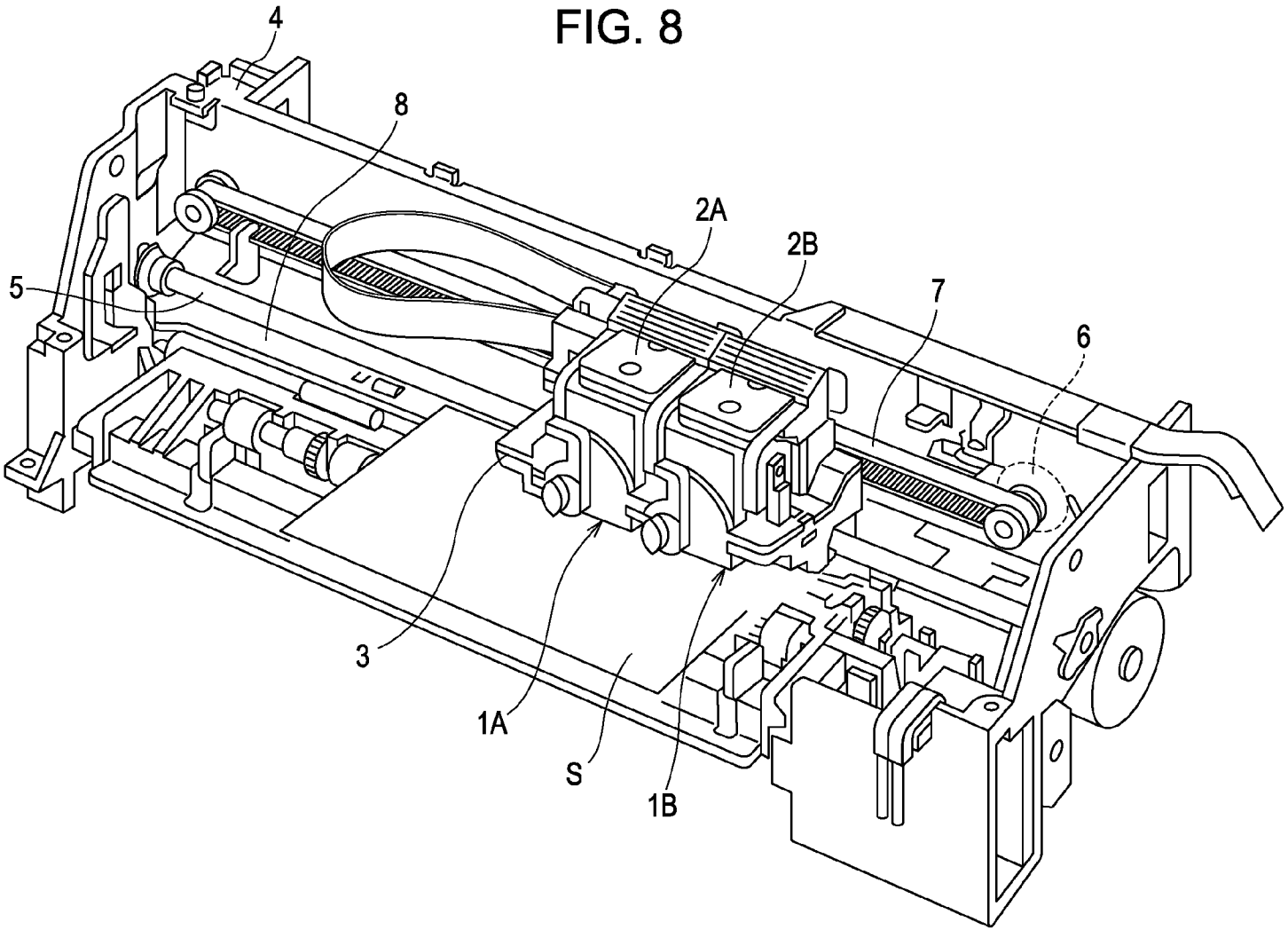
FIG. 8 is a schematic perspective view showing a recording apparatus according to an embodiment of the invention.

The ink jet recording head manufactured as described above configures a portion of a recording head unit including an ink channel communicating with an ink cartridge or the like so as to be mounted in an ink jet recording apparatus. FIG. 8 is a schematic view showing an example of the ink jet recording apparatus.

As shown in FIG. 8, cartridges 2A and 2B configuring an ink supply unit are detachably provided in recording head units 1A and 1B of the ink jet recording apparatus, and a carriage 3 in which the recording head units 1A and 1B is provided on a carriage shaft 5 mounted in an apparatus body 4 so as to be moved freely in the axial direction. The recording head unit 1A and 1B eject, for example, a black ink composition and a color ink composition, respectively.

In addition, driving force of a driving motor 6 is delivered to the carriage 3 via a plurality of gears (not shown) and a timing belt 7 such that the carriage 3 in which the recording head units 1A and 1B are mounted moves along the carriage shaft 5. Meanwhile, a platen 8 is provided in the apparatus body 4 along the carriage shaft 5 such that a recording sheet S which is a recording medium such as paper fed by a feed roller (not shown) or the like is wound on the platen 8 so as to be transported.

Although the ink jet recording apparatus of a type where the ink jet recording head is mounted in the carriage so as to be moved in the main scanning direction is exemplified in the above-described embodiment, the invention is applicable to another type of an ink jet recording apparatus. For example, the invention is applicable to a so-called line type ink jet recording apparatus in which a plurality of fixed ink jet recording heads is included so as to perform printing by moving only a recording sheet S such as paper in a sub scanning direction.

Although the ink jet recording head is exemplified as an example of a liquid ejecting head in the above-described embodiment, the invention widely aims at a liquid ejecting head and is applicable to a method of manufacturing a liquid ejecting head for ejecting a liquid other than an ink. As the other liquid ejecting heads, for example, there are various recording heads used in an image recording apparatus such as a printer, a color material ejecting head used for manufacturing color filters of a liquid crystal display, an electrode material ejecting head used for forming electrodes of an organic EL display, a Field Emission Display (FED) or the like, and a bio organic matter ejecting head used for manufacturing bio chips.

What is claimed is:

1. A method of manufacturing a liquid ejecting head, the method comprising:

forming a piezoelectric element having a length in a reference direction longer than a width in an orthogonal direction orthogonal to the reference direction on a first substrate; and adhering a second substrate to a surface of the first substrate opposed to the piezoelectric element at a temperature higher than a normal temperature, wherein the second substrate has an anisotropic first thermal expansion coefficient in the reference direction and a second thermal expansion coefficient in the orthogonal direction, wherein the first thermal expansion coefficient is greater than both the second thermal expansion coefficient and a thermal expansion coefficient of the first substrate, wherein when the first substrate and the second substrate are cooled to the normal temperature, the second substrate is contracted more than the first substrate in the reference direction such that the second substrate applies a compressive stress to the first substrate.

2. The method according to claim 1, wherein:

the first substrate is a channel forming substrate and the second substrate is a nozzle plate, the forming of the piezoelectric element includes juxtaposing a plurality of piezoelectric elements on the channel forming substrate in the orthogonal direction and juxtaposing a plurality of pressure generation chambers on the channel forming substrate in the orthogonal direction in correspondence with the piezoelectric elements, and in the adhering of the second substrate, a plurality of nozzle openings is formed in the orthogonal direction, and an absolute value of a difference between the second thermal expansion coefficient of the nozzle plate and the thermal expansion coefficient of the channel forming substrate is smaller than an absolute value of a difference between the first thermal expansion coefficient of the nozzle plate and the thermal expansion coefficient of the channel forming substrate.

* * * * *